US008939061B2

(12) United States Patent
Middelanis et al.

(10) Patent No.: US 8,939,061 B2
(45) Date of Patent: Jan. 27, 2015

(54) METHOD AND DEVICE FOR INDICATING THE POSITION OF HYDRAULICALLY ARMATURES

(75) Inventors: Michael Middelanis, Hattingen (DE); Stephan Quinkert, Bochum (DE)

(73) Assignee: Pleiger Maschinenmau GmbH & Co. KG, Witten (DE)

( * ) Notice: Subject to any disclaimer, the term of this patent is extended or adjusted under 35 U.S.C. 154(b) by 1301 days.

(21) Appl. No.: 12/676,884

(22) PCT Filed: Aug. 20, 2008

(86) PCT No.: PCT/EP2008/006856

§ 371 (c)(1),
(2), (4) Date: Jul. 28, 2010

(87) PCT Pub. No.: WO2009/033553

PCT Pub. Date: Mar. 19, 2009

(65) Prior Publication Data

US 2010/0282067 A1 Nov. 11, 2010

(30) Foreign Application Priority Data

Sep. 7, 2007 (DE) ..... 10 2007 042 757

(51) Int. Cl.
*F15B 15/28* (2006.01)

(52) U.S. Cl.
CPC ..... *F15B 15/2838* (2013.01)
USPC ..... 91/1; 92/5 R

(58) Field of Classification Search
USPC ..... 91/1; 92/5 R, 5 L
See application file for complete search history.

(56) References Cited

U.S. PATENT DOCUMENTS

| | | | | |
|---|---|---|---|---|
| 3,081,942 | A * | 3/1963 | Maclay | 91/1 |
| 4,742,794 | A * | 5/1988 | Hagstrom | 91/1 |
| 2001/0037689 | A1 | 11/2001 | Krouth et al. | |

FOREIGN PATENT DOCUMENTS

| | | | |
|---|---|---|---|
| DE | 44 29 019 | C1 | 12/1995 |
| DE | 296 16 034 | U1 | 1/1997 |
| GB | 275 844 | A | 5/1972 |
| WO | WO 98/02664 | A | 1/1998 |

OTHER PUBLICATIONS

International Search Report and Written Opinion from corresponding International Application No. PCT/EP2008/006856, filed Aug. 20, 2008 (12 pages).

* cited by examiner

*Primary Examiner* — F. Daniel Lopez
(74) *Attorney, Agent, or Firm* — Klein, O'Neil & Singh, LLP

(57) ABSTRACT

Method of indicating the position of a hydraulically actuated armature, comprising an adjust cylinder for actuating the armature, connected by at least one pressure medium line to an adjustment valve through which the pressure medium line can be switched between pressure-causing forward flow and pressure-less backward flow, wherein the flow through the pressure medium line is converted into a number of electric pulses and the number of pulses reflecting the flow is processed in a program in an indicator unit such that the number of pulses occurring in a predetermined adjustment travel when the flow in the pressure medium line is pressure-less is calculated as being the same adjustment travel as when the pressure medium line is switched to be the pressure line.

7 Claims, 1 Drawing Sheet

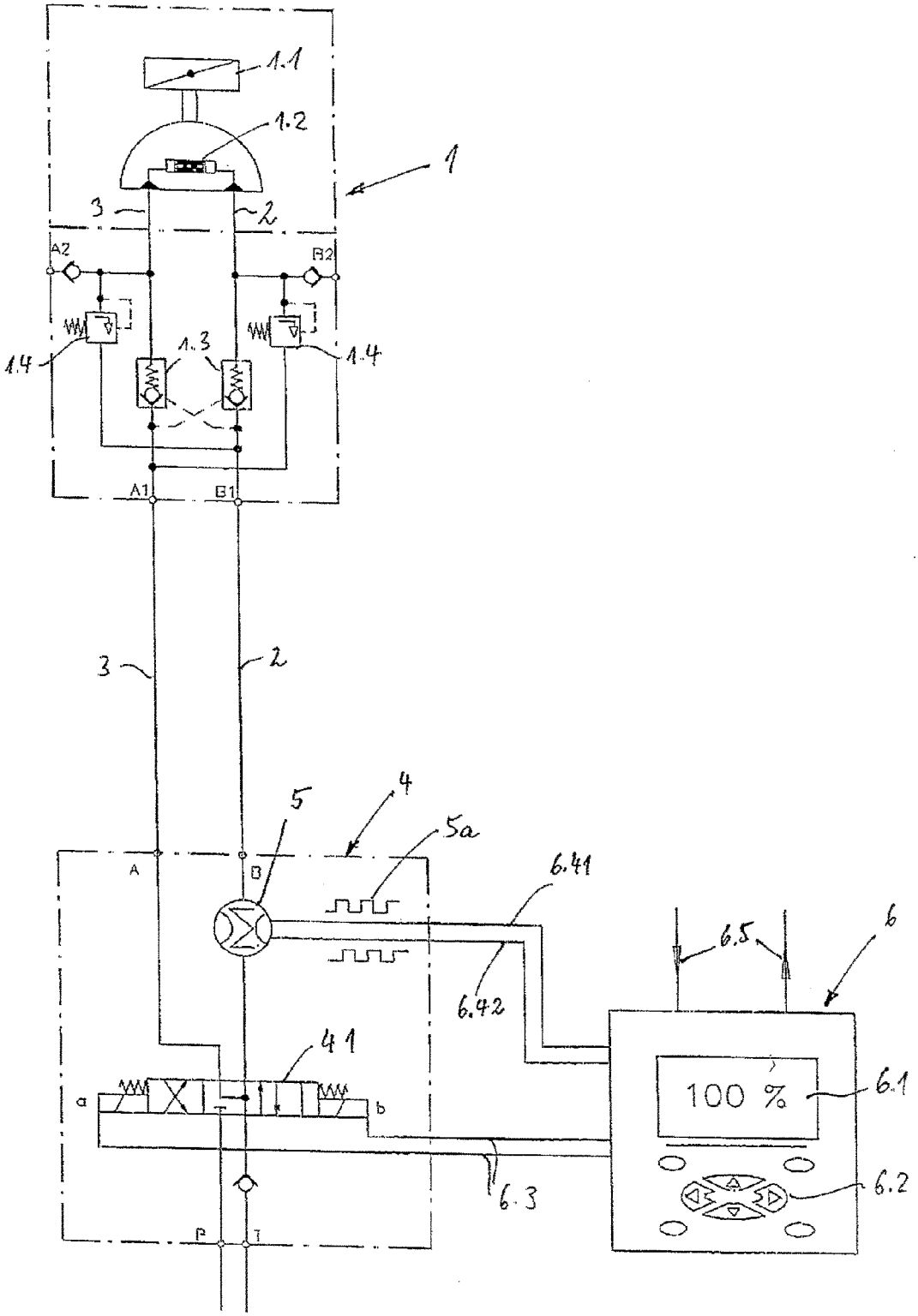
1.1
1.2
1
3
2
A2
B2
1.4
1.3
1.4
A1
B1
3
2
5
4
5a
A
B
6.41
6.5
6
6.42
41
a
b
100 %
6.1
6.3
6.2
P
T

METHOD AND DEVICE FOR INDICATING THE POSITION OF HYDRAULICALLY ARMATURES

CROSS-REFERENCE TO RELATED APPLICATION

This is a national phase application of PCT application Ser. No. PCT/EP2008/006856 , filed Aug. 20, 2008 , which claims priority to German application No. DE 10 2007 042 757 5. filed Sep. 7, 2007 , the contents of each of the foregoing are expressly incorporated herein by reference.

BACKGROUND

Embodiments described herein relate to a method and a device for indicating the position of hydraulically actuated armatures, such as in shipbuilding, which are acted on by a pressure medium via a hydraulic line from a central control unit.

The indication of the position of such hydraulically actuated armatures, such as rotary and linear drives, is performed via the displacement of the armature, which can be arranged on a ship at a distance of, for example, 200 m from the central control unit. In the case of such line lengths, the compressibility of the pressure medium has an effect on the precision of the position indicator. For example, it is known from DE 44 29 019 to provide a costly hydraulic circuit to compensate for the lack of precision of the position indicator caused by the compressibility of the pressure medium.

SUMMARY

One aspect of the present apparatuses, systems, and methods is to form a position indicator of hydraulically actuated armatures of the type mentioned above such that high precision of the position indicator is achieved at low cost.

Another aspect of the present apparatuses, systems. and methods is to convert the through flow through the hydraulic or pressure medium line into electrical pulses which are then used to indicate the position of the armatures. In the case of a simply configured device, it is possible to reliably and precisely determine the position of the armature arranged at a distance from the control unit because a pulse corresponds only to a slight volume flow rate of a pressure medium. The signal processing in a program makes it possible to compensate in a simple way for the compressibility of the pressure medium and even for temperature influences on the position indicator.

A still further aspect of the present apparatuses. systems, and methods is to compensate for the influence of the compressibility of the pressure medium, especially in the case of when the pressure medium line is switched to the pressure-causing pressure line. The higher number of pulses occurring during the actuation of the armature is counted and the lower number of pulses is subtracted therefrom, wherein the lower number of pulses is then counted when the pressure medium line is switched to be the un-pressurized return line during the same adjustment travel of the armature. In one example, the difference between the numbers of pulses corresponds to the influence of compressibility. As used herein, a pressured line may have a first pressure and a return line may have a second pressure, which is less than the first pressure. In certain embodiments, the term pressure-less or un-pressurized is used which is understood to mean less pressure than the pressure line.

According to another embodiment, the pulses are counted in the case of pre-determined adjustment travel when the pressure medium line is switched to be the pressure line. whereupon the pressure line is switched to un-pressurized and the pulses occurring during decompression are counted. The number of pulses corresponding to compressibility is left out of consideration during the further actuations of the armature, to compensate for the influence of compressibility.

SUMMARY OF THE FIGURE

Exemplary embodiments of the invention are explained in more detail below with reference to FIG. 1, which schematically shows a device for indicating a position in which the armature is acted on by two pressure medium lines.

DETAILED DESCRIPTION

The detailed description set forth below in connection with the appended drawings is intended as a description of the presently preferred embodiments of armature position indicators (herein "indicators") provided in accordance with aspects of the present invention and is not intended to represent the only forms in which the present invention may be constructed or utilized. The description sets forth the features and the steps for constructing and using the indicators of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like or similar elements or features.

With reference to FIG. 1, reference numeral 1 denotes a unit comprising for example a pivoted flap 1.1 arranged in a pipe (not shown) and being adjusted by an adjust cylinder 1.2. for example, by means of a gear rack. The adjust cylinder 1.2 being connected on opposite sides to hydraulic or pressure medium lines 2 and 3. In unit 1, return valves 1.3 and pressure-limiting valves 1.4 are arranged in a circuit which is known per se.

Reference numeral 4 refers to a schematically represented central control unit where a large number of armatures may be controlled and which can be found at a great distance from the control unit. For simplification of the representation. only one armature 1.1 is represented. For each armature, a known adjustment valve 4.1 is arranged in the control unit 4. The adjustment valve 4.1 may be used to adjust pressure to one or the other side of the adjust cylinder 1.2 while the other pressure medium line 2 or 3 respectively is switched to be the return line. P denotes a hydraulic line connected to a pressure medium source (not shown) and T denotes a return line leading to a reservoir (not shown). Thus, a feature of the embodiment is an adjustment valve 4.1 for adjusting pressure to and return direction between two lines and the adjust cylinder 1.2.

A flow rate sensor 5 is arranged in one of the two pressure medium lines 2 or 3, preferably in the area of the control unit 4. This flow rate sensor 5 converts the flow of pressure medium passing through the line into a series of electrical pulses which are indicated at 5*a*. The flow rate sensor 5 can. for example, have a gear or gear train that is driven by the pressure medium flow and generate electrical pulses in a non-contacting manner by means of Hall sensors. Such flow rate sensors or flow rate measuring devices are known per se. The signals emitted by the flow rate sensor 5 can, for example, be rectangular signals, as represented schematically at 5*a* , wherein one pulse corresponds to a predetermined unit of volume of the pressure medium. Here, a pulse can correspond to a unit of volume of, for example, 0.05 $cm^3$ of the pressure medium passing through the line.

Reference numeral 6 denotes a control and indicator unit which has a display 6.1 and control buttons 6.2 and is connected via first electric lines 6.3 at a and b to the opposite sides of the adjusting valve 4.1, which is switched to the one or other position by a solenoid in each case. Further. the indicator unit 6 is connected to the flow rate sensor 5 via second electric lines 6.41 and 6.42, through which different pulses corresponding to the throughflow direction of the pressure medium are supplied to the indicator unit 6 or to a program provided therein, in which the signals or numbers of pulses are processed. Reference numeral 6.5 denotes electric lines for the power supply to the indicator unit 6.

By using two pulse signals which are offset from each other by 90°, the flow direction of the pressure medium is revealed by means of a series of pulses. In the program of the indicator unit 6, by means of direction-determination logic the flow direction of the pressure medium is revealed as an open or close actuation. In other words, pulses are transmitted via the one electric line 6.41 when the pressure medium is flowing in one direction, and pulses are transmitted via the electric line 6.42 when the flow is in the other direction. The difference between forwards and backwards flow in the pressure medium line 2 results essentially from the rotational direction of the gear in the flow rate sensor 5 or from identifying the rotational direction at the encoder, as to whether this rotates to the right or to the left. Thus, a feature of the present apparatus, method and system is a flow direction indicator connected to an armature for indicating gear direction, pressure supply direction or both. In a particular embodiment, the direction is obtained by converting pressure and/or flow into electrical pulses.

When the pressure medium line 2 is switched to be the pressure line and the pressure medium is flowing in a direction towards the armature 1.1, due to the compressibility of the pressure medium in the pressure line, a higher number of pulses occurs than during the return flow when the pressure medium line 2, as the return line, is switched to pressureless. Hereby, the compressibility of the pressure medium can be calculated by the program located in the indicator unit 6 by means of the different number of pulses when the piston in the adjust cylinder 1.2 has the same adjustment travel. For example, compressibility can be detected by counting the number of pulses when the piston has a full adjustment travel in the adjust cylinder 1.2, when the pressure medium line 2 is switched to be the pressure-causing pressure line, and in the same way the number of pulses is counted when the pressure medium line 2 is switched to be the pressureless return line, wherein the difference in the two determined numbers of pulses having the same adjustment travel corresponds to the influence of compressibility.

In one embodiment. only the number of pulses is stored which is detected when the pressure line is decompressed. In another embodiment, the number of pulses during the closing and opening process is stored and calculated together. It is also possible to combine both embodiments in the program.

The program processing the pulses is expediently formed as a learning program wherein, after installing the position-indicating device, predetermined program steps take place by means of which the position indicator adjusts itself to the respective armature including the type of pipe. This therefore eliminates costly adaptation of the position indicator at the armatures, which often have very different displacement volumes, and at the different line lengths and line cross-sections.

According to one embodiment of the learning or checking program. the adjusting valve 4.1 is adjusted into the end position by the program in the control and indicator unit 6 via one of the electric lines 6.3 for moving towards an end position of the armature. For example, the adjusting valve 4.1 can be adjusted to move towards the closed position so that the flap connected to the adjust cylinder 1.2 is moved into the closed position via the pressure medium line 3, which is switched to be the pressure line. On reaching the closed or end position, the piston in the adjust cylinder 1.2 comes to abut at the front wall thereof so no further throughflow takes place through the pressure medium lines 2 and 3. This end position can be predetermined as the initial position for counting the pulses that occur. Hereupon the armature is moved by the program into the other end position, in this embodiment. into the open position wherein the pressure medium line 2 is switched to be the pressure line and the pulses occurring during actuation into the open position are counted. Hereupon the control valve 4.1 is offset by the program into the middle position and thus the pressure line 2 is switched to un-pressurized, wherein the pressure medium in the line 2 decompresses. Hereby. backflow occurs in the pipe 2, which corresponds to the decompression of the pressure medium and is determined with regard to its volume by counting the occurring pulses.

To compensate for the influence of compressibility in further actuations of the armature, the number of pulses measured during decompression of the pressure medium is left out of consideration when the pressure medium line 2 is again switched to be the pressure line. In other words, the number of pulses corresponding to decompression is subtracted from the previously measured complete number of pulses so that. for the predetermined adjustment travel, the number of pulses corresponding thereto is obtained.

The influence of compressibility can also be detected by counting and storing the numbers of pulses occurring during full adjustment travel of the piston in the adjust cylinder when the pressure medium line 2 is switched to be the pressure line and to be the return line, The difference between the measured numbers of pulses shows the influence of the compressibility of the pressure medium.

This learning or checking program is preferably carried out automatically before resuming use or after repairing the armature. By carrying out the checking program before each start-up, it may be possible to determine errors which have occurred in the meantime. When carrying out the checking program after repairing the armature, it is not necessary for the plant operator to carry out a readjustment of the position indicator to the existing system.

In another embodiment, the checking program is carried out when the armature is moved into intermediate positions. Hereby, the pressure medium line 2 is switched to be, for example, the pressure line to move the adjust cylinder 1.2 into a predetermined intermediate position, wherein the number of pulses occurring thereby is counted. Hereupon. the flap or the adjust cylinder is fixed in the attained intermediate position and the pressure medium line 2 is switched to un-pressurized, wherein the number of pulses occurring during decompression of the pressure means is measured. When the armature is again to be moved into the same or another random intermediate position, compensation is made for the influence of compressibility thereby occurring by leaving out of consideration the number of pulses detected during decompression.

To compensate for the temperature influences on the position indicator, for example in the case of an armature assembled on the deck of a ship in which differences of, for example, 20° C. occur between daytime and nighttime temperatures, it is predetermined in the program of the indicator unit 6 that a number of pulses of, for example. "five" per time unit is left out of consideration for the position indicator. It is assumed in this example that five pulses correspond to a volume change of the pressure medium during a higher or lower temperature compared to the normal operating temperature.

Here, empirical values are predetermined for the program. However, it is also possible to store, for example, viscosity curves of the respective pressure medium in the program, wherein it is possible in association with temperature sensors to detect the volume changes more precisely in the pressure medium as a function of temperature. To compensate for temperature influences, a temperature sensor can be provided at the flow rate sensor 5 and/or at the adjust cylinder 1.2 to transmit the corresponding measurement values to the program in the indicator unit 6.

By means of the device described, leaks in the hydraulic arrangement can also be determined and shown at the indicator unit 6, for example when pulses continue to occur in the closed position of the armature, or the measured number of pulses no longer agrees with that defined by the checking program before start-up as the number of pulses corresponding to a complete adjustment travel. Hereby, operating safety is increased by error recognition.

The program in the indicator unit 6 can also be formed to control the armature in such a way that an intermediate position of the armature of, for example, 40% can be preset at the display 6.1, whereupon the control is then triggered by one of the control buttons. Thereafter, the armature is automatically moved into the intermediate position of 40% and on reaching the intermediate position it is held in this position. Hereby, the adjustment valve 4.1 is triggered by means of the electric lines 6.3 until the predetermined intermediate position is reached, whereupon the voltage supply of the adjustment valve 4.1 is interrupted by the program. In this way, the indicator unit 6 also serves as a control unit, wherein for controlling the armature by means of the adjustment valve 4.1, the previously determined pulse data from the flow rate sensor 5 are also processed by the program.

The indicator device described is of great advantage not only in shipbuilding, because a precise position indicator can be achieved using simple means. The indicator device can also be used in industrial plants, for example in refineries. It can also be used in relatively short lines of, for example, 20 m between the control unit and the armature in which the compressibility becomes noticeable by different number of pulses between pressure-causing forward flow and un-pressurized backward flow.

The indicator device can also be provided in a hydraulically actuated armature which is supplied with pressure medium via only one pressure medium line, wherein the piston in the adjust cylinder 1.2, acted on by pressure medium, works against a spring which effects resetting of the piston when the pressure medium line is switched to backflow.

In this embodiment, the piston in the adjust cylinder can be fixed in the position with a stressed spring, so that when switching the pressure medium line to un-pressurized, it is possible to measure the number of pulses which occurs due to decompression of the pressure medium and which corresponds to the influence of compressibility on the position indicator.

Although limited embodiments of methods, systems, and devices for indicating the position of hydraulically actuated armatures and their components have been specifically described and illustrated herein, many modifications and variations will be apparent to those skilled in the art. Accordingly, it is to be understood that the methods, systems, and devices for indicating the position of hydraulically actuated armatures and their components constructed according to principles of this invention may be embodied other than as specifically described herein. The invention is also defined in the following claims.

The invention claimed is:

1. A device for indicating a position of a hydraulically actuated armature, comprising:

an adjust cylinder for actuating the armature connected by at least one pressure medium line to an adjustment valve through which the pressure medium line can be switched between forward flow and backward flow;

a through flow sensor arranged in the pressure medium line to convert a flow of the pressure medium in the pressure medium line into electric pulses and is connected to an electronic indicator unit for processing the pulses;

wherein a program in the electronic indicator unit counts the occurring pulses and compares the numbers of pulses occurring in a flow of the pressure medium line in one direction and in an opposite direction, which determines a difference of the electric pulses of the flow of the pressure medium between the forward flow and the backward flow corresponds to the effect of compressibility of the pressure medium.

2. The device of claim 1, wherein the number of electric pulses are used to define a position of the armature.

3. The device of claim 1, wherein the through flow sensor is arranged only in one pressure medium line when the armature is acted on by pressure medium through two pressure medium lines.

4. A method for indicating a position of a hydraulically actuated armature, comprising:

an adjust cylinder for actuating the armature connected by at least one pressure medium line to an adjustment valve through which the pressure medium line can be switched between forward flow of a first pressure and backward flow of a second pressure, which is less than the first pressure;

converting both the forward flow and the backward flow through the pressure medium line into a number of electric pulses;

processing the number of electric pulses in an indicator unit located remotely from the armature by comparing the number of electric pulses corresponding to the forward flow and the number of electric pulses corresponding to the backward flow, and determining a difference as a measure of compressibility of the pressure medium; and activating the adjustment valve.

5. The method of claim 4, wherein the number of electric pulses are processed in a program located in the indicator unit and wherein the program automatically performs adjustment of the position indicator to the displacement of the respective armature.

6. The method of claim 5, wherein the program performs a check or adjustment of the position indicator when resuming use of the armature.

7. The method of claim 4, wherein the number of electric pulses are used to define a position of the armature.

* * * * *